US009352809B2

(12) United States Patent
Roodenburg et al.

(10) Patent No.: US 9,352,809 B2
(45) Date of Patent: May 31, 2016

(54) SEMI-SUBMERSIBLE VESSEL AND OPERATING METHOD

(75) Inventors: Joop Roodenburg, Delft (NL); Marc Louis Brinkman, Delft (NL); Alexei Bereznitski, Delft (NL)

(73) Assignee: ITREC B.V., Schiedam (NL)

( * ) Notice: Subject to any disclaimer, the term of this patent is extended or adjusted under 35 U.S.C. 154(b) by 468 days.

(21) Appl. No.: 13/808,778

(22) PCT Filed: Jul. 7, 2011

(86) PCT No.: PCT/NL2011/050494

§ 371 (c)(1),
(2), (4) Date: Mar. 5, 2013

(87) PCT Pub. No.: WO2012/005587

PCT Pub. Date: Jan. 12, 2012

(65) Prior Publication Data

US 2013/0160693 A1 Jun. 27, 2013

(30) Foreign Application Priority Data

| | | |
|---|---|---|
| Jul. 8, 2010 | (NL) | 2005058 |
| Dec. 22, 2010 | (NL) | 2005897 |
| Jan. 28, 2011 | (NL) | 2006095 |

(51) Int. Cl.
*B63B 35/08* (2006.01)
*B63B 35/44* (2006.01)
(Continued)

(52) U.S. Cl.
CPC ..... *B63B 35/4413* (2013.01); *B63B 1/04* (2013.01); *B63B 35/44* (2013.01); *E21B 19/143* (2013.01); *B63B 35/08* (2013.01); *B63B 2001/044* (2013.01); *B63B 2241/12* (2013.01)

(58) Field of Classification Search
CPC ..... B63B 1/02; B63B 1/04; B63B 35/08; B63B 35/083; B63B 35/086; B63B 35/44; B63B 35/4413; B63B 35/442; B63B 2001/044; B63B 2241/12; E21B 19/143
USPC ..... 114/40, 264, 265; 405/195.1–209, 211, 405/217, 224–224.4
See application file for complete search history.

(56) References Cited

U.S. PATENT DOCUMENTS

| | | | | |
|---|---|---|---|---|
| 3,952,527 | A * | 4/1976 | Vinieratos et al. | 405/217 |
| 4,048,943 | A * | 9/1977 | Gerwick, Jr. | 114/256 |

(Continued)

FOREIGN PATENT DOCUMENTS

| | | |
|---|---|---|
| EP | 0 124 338 A1 | 11/1984 |
| JP | 57-187412 A | 11/1982 |

(Continued)

*Primary Examiner* — Ajay Vasudeva
(74) *Attorney, Agent, or Firm* — Birch, Stewart, Kolasch & Birch, LLP

(57) ABSTRACT

A semi-submersible vessel for offshore operations is suitable to be operated in icy waters and in ice-free waters. The vessel includes an operating deck, at least one lower hull, an essentially vertical connecting structure between the at least one lower hull and the operating deck, and a ballast system. The connecting structure has a water portion and an icebreaking portion arranged on top of each other. The vessel is configured to have an icebreaking draft for icy waters, and a water draft for ice-free waters in which the waterline is substantially level with the water portion. The icebreaking portion has a closed tapered contour. During the water draft, the collective area of the water portion of the connecting structure intersecting the water surface is smaller than the collective area of the ice-breaking portion of the connecting structure intersecting the water surface during the icebreaking draft.

20 Claims, 4 Drawing Sheets

(51) Int. Cl.
*E21B 19/14* (2006.01)
*B63B 1/04* (2006.01)

(56) References Cited

U.S. PATENT DOCUMENTS

| | | | | | |
|---|---|---|---|---|---|
| 4,335,980 | A | * | 6/1982 | DePriester | 405/217 |
| 4,434,741 | A | * | 3/1984 | Wright et al. | 114/264 |
| 4,457,250 | A | | 7/1984 | Oshima et al. | |
| 4,646,672 | A | | 3/1987 | Bennett et al. | |
| 4,808,036 | A | * | 2/1989 | Bhalaik et al. | 405/217 |
| 2009/0126616 | A1 | * | 5/2009 | Srinivasan | 114/264 |

FOREIGN PATENT DOCUMENTS

| | | | |
|---|---|---|---|
| JP | 59-104897 | U | 7/1984 |
| JP | S61102909 | A | 5/1986 |
| RU | 943090 | A1 | 7/1982 |
| WO | WO 2009/136799 | A1 | 11/2009 |
| WO | WO 2010/126629 | A1 | 11/2010 |

* cited by examiner

SEMI-SUBMERSIBLE VESSEL AND OPERATING METHOD

The invention relates to a semi-submersible vessel for offshore operations having an operating deck to accommodate equipment, at least one lower hull, a ballast system to ballast and deballast the vessel, and a connecting structure connecting the operating deck and the at least one lower hull.

Such semi-submersible vessels are commonly used in a number of specific offshore roles such as for offshore drilling rigs, safety vessels, oil production platforms and heavy lift cranes.

An advantage of semi-submersible vessels over a normal ship is that a limited sensitivity to waves and good seakeeping characteristics can be obtained by providing ballasted, watertight, lower hulls, e.g. pontoons, below the water surface and wave action. The operating deck is situated high above the sea level and thus kept well away from the waves. The function of the connecting structure is to support the operating deck from the at least one lower hull while keeping the water-plane area, i.e. the horizontal cross-sectional area or in other words the area of the connecting structure intersecting with the water surface, relatively small in order to keep the influence of waves on the vessel small compared to a mono hull vessel. As a result, a semi-submersible is less affected by wave loadings than a normal ship, which is advantageous while performing offshore operations. The advantages of semi-submersible vessels are well-known in the art.

An example of such a semi-submersible vessel is shown in US patent publication U.S. Pat. No. 4,646,672. A disadvantage of current semi-submersible vessels is that they are not particularly suitable for icy waters, i.e. ice-infested waters.

It is therefore an object of the invention to provide a semi-submersible vessel that is suitable for both ice-free waters and icy waters.

The invention therefore provides a semi-submersible vessel for offshore operations which is suitable to be operated in icy waters and in ice-free waters, said vessel comprising:

an operating deck to accommodate equipment;

at least one lower hull, e.g. a pontoon;

an essentially vertical connecting structure between the at least one lower hull and the operating deck;

a ballast system to ballast or deballast the vessel;

wherein the connecting structure has a water portion and an icebreaking portion being arranged on top of each other, wherein the vessel is configured to have an icebreaking draft for icy waters in which the water- or iceline is substantially level with the icebreaking portion, and a water draft for ice-free waters in which the waterline is substantially level with the water portion, wherein the icebreaking portion has a closed tapered contour, and wherein during the water draft the collective area of the water portion of the connecting structure intersecting the water surface is smaller than the collective area of the icebreaking portion of the connecting structure intersecting the water surface during the icebreaking draft.

An advantage of the semi-submersible vessel according to the invention is that the vessel due to its ballast system is able to adapt its draft to the condition of the surrounding water. If the surrounding water is ice-free, the semi-submersible vessel can be operated in the water draft in which the waterline is substantially level with the water portion, thereby ensuring that the vessel has a typical semi-submersible behaviour in which the influence of waves is minimal. However, if the surrounding water is filled with ice, entirely or partially, the semi-submersible vessel can change its draft to the icebreaking draft in which the water- or iceline is substantially level with the icebreaking portion. Changing the draft of the vessel is done by appropriately operating the ballast system.

The icebreaking portion is due to its tapered contour able to break or at least deflect the ice when it hits the vessel. This icebreaking property of the icebreaking portion is in case of icy waters more important then the increased influence of waves on the vessel due to the larger water surface intersecting area of the icebreaking portion.

As a result, a more versatile semi-submersible vessel is obtained which can adapt to the surrounding conditions of the water by changing its draft.

In an embodiment, the icebreaking portion has an essentially circular shape, i.e. the closed contour has a circular horizontal cross section. Preferably, a single closed tapered contour is provided for the icebreaking portion. An advantage of the circular configuration is that ice may come from any direction, i.e. the forces on the vessel are substantially independent on the orientation of the vessel. Less advantageous, but also within the scope of the invention are other shapes of the icebreaking portion, e.g. square, rectangular, oval, etc.

The contour of the icebreaking portion may taper upwardly or downwardly as both shapes are able to break ice. Also the combination of an upwardly and downwardly tapered shape is possible. For instance, the icebreaking portion may have an hourglass shaped contour, i.e. two opposed cones on top of each other.

To withstand the relatively high forces during breaking of ice, the contour may be formed by a wall which is preferably thicker than walls used for the water portion and the lower hull, preferably said wall is made of metal. The wall may be roughened or comprise protrusions, may be smooth and/or coated, and may not have to be 100% closed. Small openings, such as closable hatches, perforations, etc. still fall within the scope of the invention as long as the majority of the contour is closed, i.e. a solid wall. The small openings may advantageously be used to allow ventilation in the icebreaking portion.

In an embodiment, the outer contour of the icebreaking portion may be provided with heat elements to heat up the outer contour and/or the ice which aids in breaking the ice.

When the tapered contour of the icebreaking portion tapers downwardly, a vertical extending contour is preferably provided adjacent and below the tapered contour, so that ice hitting the tapered contour is deflected towards the vertical extending contour which aids in breaking the ice and prevents ice from getting under the vessel.

It is advantageous to provide a mainly symmetrical water portion and/or lower hull around a vertical centre axis of the vessel, so that the behaviour of the vessel becomes independent of its orientation during water draft.

In an embodiment, the lower hull has a disk shape in plan view, preferably a ring shape in plan view with an inner and outer diameter. The lower hull may comprise circular segments or pontoons having the shape of circular segments seen in plan view instead of a full circle/ring.

In an embodiment, the vessel is also configured to have a transit draft for transportation purposes in which the waterline is level with the at least one lower hull, wherein all lower hulls preferably lie in the same horizontal plane. This reduces the amount of drag during the transportation significantly compared to the water and icebreaking draft. The transit draft is usually obtained by fully deballasting the vessel using the ballast system, which has the additional advantage of a less heavy vessel which is also advantageous for transportation.

In an embodiment, the vessel comprises at least one lower deck below the operating deck, which lower deck is integrated in the icebreaking portion. As a result, the at least one lower deck can advantageously be used to strengthen the icebreaking portion, so that other heavy reinforcement structures may be omitted, and thus an optimal weight-strength ratio of the icebreaking portion is obtained. The lower decks may advantageously be used to store equipment which may then be protected from harsh environments common in icy waters.

In an embodiment, the water portion of the connecting structure comprises multiple columns. The multiple columns can be provided between the icebreaking portion and the operating deck, so that the water portion is located above the icebreaking portion, or the multiple columns can be provided between the icebreaking portion and the at least one lower hull, e.g. at least one pontoon, so that the water portion is located below the icebreaking portion. There is also an embodiment possible, in which the connecting structure comprises multiple icebreaking portions and/or multiple water portions, so that for instance an icebreaking portion may be sandwiched between two water portions, or a water portion is sandwiched between two icebreaking portions.

In an embodiment, the outer contour of the connecting structure has an hourglass shape, i.e. a truncated inverted cone on top of a truncated cone. In a first situation the truncated inverted cone is formed by the water portion and the truncated cone is formed by the icebreaking portion and thus the water portion is located above the icebreaking portion. In a second situation the truncated inverted cone is formed by the icebreaking portion and the truncated cone is formed by the water portion and thus the water portion is located below the icebreaking portion. In case the water portion has a cone shape and comprises multiple columns, this means that the columns extend obliquely relative to a vertical axis of the vessel and point to a common point in space.

In case of the first situation in which the water portion is located above the icebreaking portion, ice colliding with the icebreaking portion is deflected upwardly towards the operating deck. The inverted cone shape of the water portion aids in breaking the ice and prevents the ice from being deflected onto the operating deck.

In case of the second situation in which the icebreaking portion is located above the water portion, ice colliding with the icebreaking portion is deflected downwardly towards the at least one pontoon. The cone shape of the water portion again aids in breaking the ice and prevents the ice from being deflected below the vessel and possibly damage mooring lines with which the vessel may be anchored to the bottom of the sea.

An advantage of a lower portion of the connecting structure tapering upwardly is that the lower hull connected to the lower portion of the connecting structure may have a large distance to the centre of the vessel, thereby improving the behaviour of the vessel, e.g. increasing the resistance against sea state induced roll and pitch motions.

In an embodiment, the multiple columns are distributed, preferably evenly distributed, around a central space. This leaves the centre of the vessel at the height level of the water portion free to allow operations, such as drilling operations to take place in the centre of the vessel.

In an embodiment, one or more openings in the water portion, e.g. openings between the multiple columns, through which ice may enter the central space in the water portion thereby possibly causing problems or damage to drilling equipment may be provided with a net or mesh structure to prevent ice from entering the central space via the openings, while water can freely pass the net or mesh structure. The net or mesh structure can be flexible, but may also be provided as rigid rods arranged such that a net or mesh structure is obtained in the openings. The size of the openings in the net or mesh structure define the size of ice parts that will be prevented from entering the central space.

The net or mesh structure may further be advantageously used as heating elements, e.g. by passing hot water through the rigid rods. Ice elements hitting the net or mesh structure will then be heated and will melt as a result thereof, thereby reducing the risk of the ice elements becoming a problem during operation of the vessel. The hot water running through the rigid rods may originate from for instance cooling water for engines which are then advantageously cooled using the net or mesh structure.

In an embodiment, cooling of equipment on the vessel can be achieved by dumping heat in the central space between the multiple columns. This has the additional advantage that ice elements that have penetrated into the central space are subjected to heat and thus the chance of the ice elements becoming a problem is reduced.

In an embodiment, the net or mesh structure is cooled thereby being able to close the openings in the net or mesh structure by the formation of ice. In this way, the openings in between the multiple columns can be controllably closed to protect the central space from the penetration of ice elements. When the ice needs to be removed from the net or mesh structure, the net or mesh structure can be heated as described above. Cooling of the net or mesh structure can be done using cool air that might be freely available due to the low-temperature environment.

In an embodiment, the lower hull is a ring-shaped lower hull, which leaves the centre of the vessel at the height level of the lower hull free for drilling operations. Also the combination of columns and a ring-shaped lower hull is possible.

Preferably, a moonpool is provided in the operating deck and a hole/opening is provided in the icebreaking deck to allow drilling equipment, such as drilling tubulars to extend through the vessel.

In an embodiment, a protective wall may extend downwards from the vessel in the central space around the moonpool as protection of the drilling equipment extending through the moonpool against ice that has entered the central space. The protective wall preferably extends to below the water draft for that purpose. The protective wall does not necessarily have to be a solid wall, but may have small openings for air and water to pass the wall.

In an embodiment, additional openings or through holes extend through the operating deck up until the central space so that air is able to flow between the central space and the surroundings of the vessel via the openings or through holes. Preferably, the openings or through holes are provided with respective valves to allow the controlled opening or closing of the openings/holes. This is especially advantageous when air becomes trapped in the central space, e.g. due to the use of a protective wall. When the vessel submerges, the pressure in the trapped air will increase, where in the case the vessel resurfaces, the pressure will drop. By opening the valves in the openings or through holes, air can be exchanged with the surroundings so that the pressure remains substantially constant. It is also possible that the additional openings or through holes extend from the central space to another portion of the vessel, for instance the side surface of the vessel above water level. The cross-section of the openings or through holes is preferably limited to prevent the air from slamming. When a certain draft is reached, the respective valves can be closed again.

In an embodiment, the number of columns comprised in the water portion is between 4 and 12, preferably between 6 and 10, and more preferably 8.

In an embodiment, the area of the connecting structure being intersected by the water surface during the water draft in water draft conditions comprises multiple separate cross-sections corresponding to the respective multiple columns. The multiple separate cross-sections may be placed in a circular manner to define a circumscribed circle and an inscribed circle. The circumscribed circle and the inscribed circle together form a ring shape. The collective area of the multiple separate cross-sections being intersected by the water surface in water draft is preferably between 50 and 70% of the total area of the ring. More preferably, the collective area of the multiple cross-sections is about 60% of the total area of the ring. When this is combined with the feature that there are about 8 columns present in the water portion as described above, an optimum may be reached with respect to motion behaviour of the vessel relative to structural feasibility.

An advantage of the embodiment having columns is that the water volume surrounded by the columns has a tendency to behave as a partially closed system. Said water volume is only able to communicate with the surrounding water via openings in between the columns and a preferred opening in the lower hull, preferably annular lower hull. By setting the size of said openings and thereby setting the flow resistance for water flowing from the water volume to the surrounding water or vice versa, the behaviour of the water volume can be optimized.

As an example, the water volume will have a so-called piston mode of the vertical water motion, wherein setting the size of the present openings is able to tune the frequency of this piston mode motion. As a result, the frequency of the piston mode motion can be tuned such that the water volume moves in opposite phase to the motion of the water surrounding the semi-submersible vessel. In result, the excitation forces on the vessel caused by the vertical motion of the water volume and the motion of the surrounding water will compensate each other, so that the heave motion of the vessel remains relatively low.

Limited heave motion is an important requirement in case of using the semi-submersible as a drilling vessel in open water. The natural heave period is preferably longer than a typical range of wave periods in the area in which the vessel is operated. Normally, a natural heave period of 21 seconds is considered to be necessary for operation in harsh environments.

By optimizing the size of the aforementioned openings, which can be optimized by optimizing the shape and size of the columns and/or lower hull, the natural period of the piston mode motion can be set in a typical range of 4-15 seconds. As a result, the compensating effect still happens at periods shorter than the natural heave period of the vessel. The optimum can be found by minimizing both the heave motions in the range of the wave periods and the heave motions around the natural heave period.

In an example, when the lower hull is a ring-shaped lower hull, i.e. ring-shaped pontoon, the shape and size of the pontoon can be optimized in the design stage of the vessel by changing the inner and/or outer diameter of the pontoon while keeping the total volume of the pontoon the same to keep the same buoyancy. If the vertical height of the pontoon is constant, changing the inner diameter will automatically determine the outer diameter. It has been found that adjusting the shape of the opening in the ring-shaped pontoon and thus changing the shape of the pontoon has more influence on the behaviour than adjusting the shape of the openings between the columns.

In an embodiment, the opening in the lower hull and/or openings in between the columns may be adjustable during operation, e.g. by moveable barriers on the vessel. In this way, the frequency of the piston mode motion can be changed and adapted to the water conditions, thereby being able to tune the behaviour of the vessel during operation.

In an embodiment, the water portion may have a closed contour. An advantage is that equipment extending through the center of the vessel is protected from the surroundings, e.g. wind, ice, etc.

An advantage of the water portion comprising columns over a water portion having a closed outer contour is that in case of a moonpool in the operating deck, the amount of air flowing through the moonpool as a result of vessel or water motions is minimized, because air is able to flow through the openings between the columns.

The vessel may further include mooring lines, e.g. in the form of mooring chains that may be stored in chain lockers provided in the bottom part of the vessel, e.g. in the lower hull or pontoon. When the mooring chains are connected to the bottom of the sea, the chain lockers are substantially empty and may be used by the ballast system to ballast and deballast the vessel, i.e. the chain lockers may be filled by water and/or air in order ballast and deballast the vessel.

In an embodiment, the vessel is configured such that the centre of gravity of the vessel can be positioned above a centre of buoyancy during at least one of its drafts. Preferably, the centre of gravity is above the centre of buoyancy during the water draft. During the icebreaking draft, the centre of buoyancy may be above the centre of gravity.

In an embodiment, the vessel may be provided with a dynamic positioning system having thrusters mounted to for instance the lower hull to position the vessel at a desired position.

The invention also relates to a drilling installation for drilling a subsea well, for example an oil, a gas, or a thermal well, by means of said installation, which installation comprises:

- a tower;
- hoisting means adapted to manipulate drilling tubulars in at least one vertically extending firing line;
- a storage device for storing drilling tubulars;
- a pipe racker for moving drilling tubulars between the storage device and the at least one firing line, wherein the tower has over the majority of its length, preferably its entire length, a circular cross-section in plan view.

The tower has a closed outer contour with an outer wall. This allows the drilling installation to be used in harsh conditions such as in icy waters.

Advantages of a circular cross-section is that a more aerodynamic profile is provided for the tower, resulting in reduced loads on the tower due to wind, and an independency of the load to the orientation of the tower. Towers which are winterized and thus have a closed outer contour are more susceptible to wind loads than a normal open tower, so that the circular cross-section is even more advantageous in this situation than for an open tower.

In an embodiment, the tower has a cone shape, preferably a slender cone shape in which the height of the tower is larger than the maximum diameter of the tower. The tower may be a truncated cone possibly having a closed top to prevent snow or rain entering the tower from above.

In an embodiment, the storage device and the pipe racker are located inside the tower. This is especially advantageous in case of a winterized tower in which protection of all equipment is desired. It further simplifies the handling of the drilling tubulars inside the tower. Combined with a separate storage location of drilling tubulars being arranged below the drilling installation, e.g. on a lower deck of a vessel, the drilling tubulars may be transferred between the tower and the separate storage location without being exposed to the harsh conditions and thus without requiring large openings in the tower. The same can be applied to the storage device itself.

In an embodiment, the closed outer contour is formed by plate material supported by a framework.

In an embodiment, the closed outer contour is formed by plate material which is self-supporting, i.e. not requiring a separate framework to support the plate material, and may be strengthened by reinforcement elements, e.g. ribs or stiffeners, on the inside or outside of the outer contour.

The invention also relates to a semi-submersible vessel comprising a drilling installation according to the invention, e.g. a vessel as explained herein.

In an embodiment, the vessel comprises a circular shaped operating deck formed by circular shaped or arranged structural components, wherein the tower is integrated with the structural components of the operating deck. Due to the circular cross-section of the tower, the drilling installation can easily be adapted to the construction of the semi-submersible vessel.

A circular semi-submersible may comprise vertical construction elements that extend in radial direction seen in plan view. A circular tower can easily be integrated with these construction elements, so that loads induced by the tower can efficiently be transferred to the construction elements without too much deformations and/or reinforcement issues.

In an embodiment, the vessel comprises a moonpool through which the drilling installation is able to perform drilling operations, and wherein a wall portion defining the outer perimeter of the moonpool is integrated with the tower of the drilling installation provided above the moonpool.

In an embodiment, the semi-submersible vessel is a semi-submersible vessel as described above.

The invention also relates to a method for operating a semi-submersible according to the invention, wherein the ballast system is operated to change the draft of the semi-submersible to the water draft when the semi-submersible is in ice-free waters, and wherein the ballast system is operated to change the draft of the semi-submersible to the icebreaking draft when the semi-submersible is in icy waters.

The invention also relates to a semi-submersible vessel for offshore operations which is suitable to be operated in icy waters and in ice-free waters, said vessel comprising:

a circular shaped operating deck to accommodate equipment;

an annular, i.e. ring-shaped, lower hull, e.g. pontoon;

a connecting structure between the lower hull and the operating deck;

a ballast system to ballast or deballast the vessel;

wherein the connecting structure has a water portion and an icebreaking portion, said icebreaking portion being arranged on top of the water portion, wherein the water portion comprises columns arranged in a circular shape and extending obliquely inward from the lower hull, wherein the icebreaking portion has a closed downwardly tapering contour, such that the connecting structure has an hour-glass shape, wherein the vessel is configured to have an icebreaking draft for icy waters in which the water- or iceline is substantially level with the icebreaking portion, and a water draft for ice-free waters in which the waterline is substantially level with the water portion, and wherein during the water draft the collective area of the columns intersecting the water surface is smaller than the collective area of the icebreaking portion of the connecting structure intersecting the water surface during the icebreaking draft.

Said semi-submersible vessel may also comprise features already described above if applicable.

The invention will now be described in a non-limiting way with reference to the drawings, in which like numerals refer to like parts, and in which.

Figure 1:
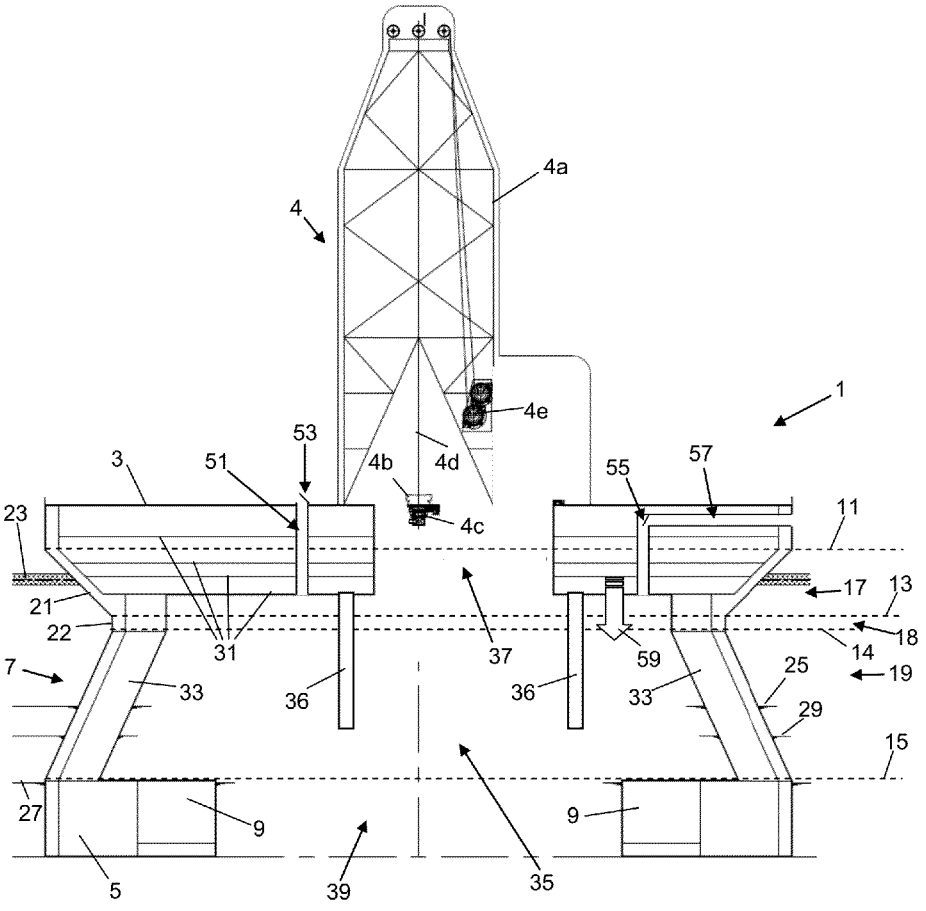
FIG. 1 depicts a vertical cross-section of a semi-submersible vessel according to an embodiment of the invention.

FIG. 1 depicts a vertical cross-section of a semi-submersible vessel 1 according to an embodiment of the invention. The vessel 1 comprises an operating deck 3 to accommodate equipment. In this embodiment, the equipment comprises a drilling installation 4 with a tower 4*a* and hosting means comprising a load connector 4*b* holding a top drive 4*c*, a hoisting cable 4*d* and a hoisting winch 4*e*. The tower 4*a* may have a closed wall with a circular cross-section in plan view. In this embodiment, a major portion of the tower thus has a cylindrical shape. On top of the cylindrical shape a cone-shaped portion is provided.

The vessel 1 further comprises a pontoon 5 and an essentially vertical connecting structure 7 between the pontoon 5 and the operating deck 3.

At different heights of the connecting structure, dashed horizontal lines 11,13,14,15 are drawn in order to indicate the different portions of the connecting structure. Between the dashed lines 11 and 13, an essentially circular icebreaking portion 17 is provided having a closed tapered contour 21. Here the taper is downward. At dashed line 11, the diameter of the icebreaking portion 17 may for example be about 106 m, whereas the diameter at dashed line 13 may be about 90 m. Between the dashed lines 13 and 14 an intermediate portion is provided as will be explained in more detail below. Between the dashed lines 14 and 15 a water portion is provided. The icebreaking portion 17 is in this embodiment thus arranged on top of the water portion 19.

The vessel 1 further comprises a water ballast system. In this embodiment, the ballast system comprises multiple ballast tanks 9 that are arranged in the pontoon 5. The ballast system is configured to ballast and deballast the vessel and thereby change the draft of the vessel as will be explained in more detail below. Ballasting the vessel may be done by filling the tanks in the pontoon and possibly also tanks in the connecting structure with water. Deballasting the vessel may be done by emptying said tanks in the pontoon and possibly in the connecting structure. It is mentioned here that the water ballast system and its operation are well-known in the art of semi-submersible vessels and will not be described in more detail here.

The vessel 1 is configured to have an icebreaking draft for icy waters in which the water- or iceline 23 is substantially level with the icebreaking portion 17, and a water draft for ice-free waters in which the waterline 25 is level with the water portion 19.

In this embodiment, the vessel also has a transit draft for transportation purposes in which the waterline 27 is level with the pontoon 5, and a survival draft for rough waters in which the waterline 29 is level with the water portion but below the waterline 25 during normal operations. Due to this lower waterline, the vessel is able to better withstand a rough sea with relatively high waves, as the relatively high waves have less chance of reaching the operating deck.

In FIG. 1, all the waterlines 23,25,27,29 are shown at the same time. However, it will be understood by a person skilled in the art that only one waterline can be applicable at the same time. All waterlines are only shown for clarification of the invention.

The height of the vessel 1 between the bottom of the pontoon and deck 3 may in the order of 50 m. In that case, the iceline 23 may be at a distance of about 40 m above the bottom of the pontoon 5, and the waterline 25 may be at a distance of about 18-22 m above the bottom of the pontoon 5.

The vessel 1 also comprises lower decks 31 beneath the deck 3, which lower decks in this case are integrated into the icebreaking portion of the connecting structure.

The icebreaking portion has a disc shape which provides for a rigid structure able to withstand the high forces of the ice surrounding the vessel.

In the embodiment of the FIG. 1, the water portion comprises multiple columns 33 evenly distributed about a central space 35 below the deck structure. In FIG. 1, only two columns 33 are shown.

The multiple columns 33 here extend obliquely inward relative to a vertical direction from the pontoon, such that in combination with the downward tapering icebreaking portion the outer contour of the connecting structure has an hourglass shape. The icebreaking portion 17 forms the inverted truncated upper cone of the hourglass shape and the columns form the truncated lowed cone of the hourglass shape. An advantage of the hourglass shape is that the pontoon 5 at the lower end of the hourglass shape can have a relatively large outer radius improving the behaviour of the vessel.

The shown pontoon 5 is ring-shaped and has a circular outer contour and a circular inner contour. Preferably, as shown in this embodiment, the pontoon has a large horizontal cross-section compared to the water portion, as a large horizontal cross-section of the pontoon 5 provides damping against sea state induced motions.

A moonpool 37 here extends through the operating deck and the lower decks of the icebreaking portion, so that drilling operations can be performed through the moonpool 37 and central space 35 and through an eye opening 39 of the ring-shaped pontoon 5.

Extending downwards from the vessel, i.e. downwards from the lower decks 31, in the central space 35 around the moonpool 37 is a vertical wall 36. The vertical wall extends to below the waterline 25 corresponding to the water draft, so that during the water draft ice parts that enter the central space through the openings in between the columns 33 is prevented from reaching the drilling equipment which extends through the moonpool into the water. The vertical wall 36 may be provided with small openings to allow water and air (and preferably ice parts small enough not to pose any threat to the drilling equipment) to pass the vertical wall.

Extending from the central space 35 through the decks to the environment are two through holes, respectively through hole 51 and 57. Through hole 51 is a through hole that extends from the central space through the operating deck 3. Through hole 57 extends from the central space 35 to the side of the vessel. Both are able to exchange air between the central space and the environment.

Provided in through hole 51 is a valve 53 that is arranged at the operating deck 3. A valve 55 is also provided in through hole 57, but valve 55 is arranged half-way the through hole 57 instead of at an end of a through hole as is the case for valve 53 and corresponding through hole 51. Both valves 53, 55 are shown in an open state, but can be closed in order to close the respective through holes. The valves may be used to influence the behaviour of the vessel as they influence the flow behaviour of air between the central space and the environment and air in the central space can have a huge impact on the behaviour due to its spring-like behaviour when at least partially trapped.

Provided on the decks of the vessel may be equipment that generates waste heat, e.g. engines and motors. This heat may be dumped from the equipment on the decks in the central space 35 as schematically indicated by the arrow 59 to heat the air there and preferably also heats directly or indirectly ice elements inadvertently entering the central space 35 to minimize the influence of the ice elements on the operation of the vessel by melting the ice elements.

Figure 2:
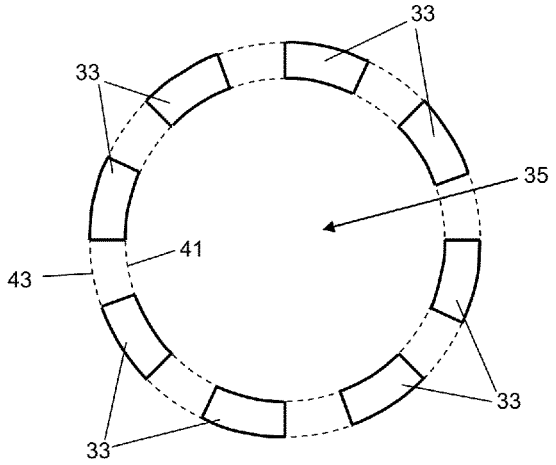
FIG. 2 depicts a horizontal cross sectional view of a water portion of the semi-submersible vessel of FIG. 1.

FIG. 2 depicts a horizontal cross-sectional view of the water portion 19 of the semi-submersible vessel 1 of FIG. 1. It is now visible that in this embodiment eight columns 33 are provided which connect the icebreaking portion 17 and the pontoon 5 of FIG. 1. The eight columns 33 are evenly distributed about the central space 35 in a circular manner. Together the eight columns, i.e. the cross sections of the eight columns define a inscribed circle 41 and a circumscribed circle 43. The circles 41 and 43 together form a ring.

In this embodiment, the cross sections of the columns are sectional portions of the circle, i.e. their cross sections fit neatly into the ring. However, the cross sections may also be rectangular or circular. Further, the columns itself may not be located in a perfect circular manner, e.g. ovally or rectangularly.

The collective area of the cross sections of the columns is preferably 50-70%, in this embodiment about 60%, of the total area of the ring formed by circles 41 and 43.

Referring to FIG. 1, the connecting structure of FIG. 1 also comprises an intermediate portion 18 between dashed lines 13 and 14 which is a preferred option. The intermediate portion has a closed vertically extending contour 22 which aids in breaking ice during the icebreaking draft. Ice hitting the contour 21 will be deflected downwards towards the water portion. If the intermediate portion 22 would be absent, there is a chance that said ice will move between the columns into the central space 35 and is able to damage drilling equipment there. By providing the intermediate portion 22 directly below the portion 19, deflected ice will first hit the intermediate portion before reaching the water portion, so that the ice is broken first and the chance of ice moving to the central space is diminished and even when ice reaches the central space, the damaging effect is less as the ice has broken into smaller pieces. When the water portion has a closed contour, the intermediate portion may be omitted as there is less chance of ice getting into space 35 due to the closed contour.

Figure 3A:
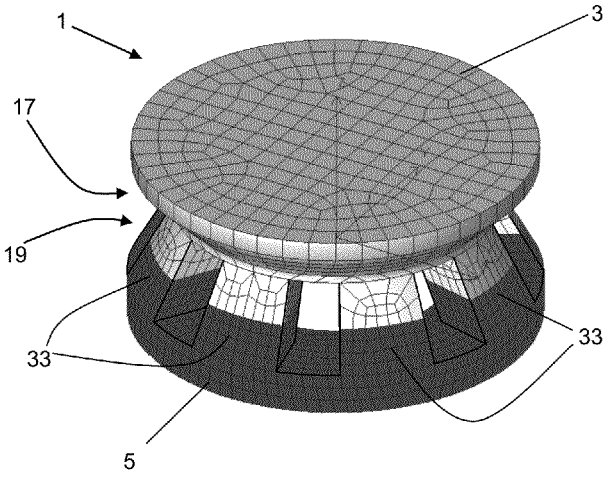
FIG. 3A depicts a highly schematic perspective view of the semi-submersible vessel of FIG. 1.

FIG. 3A depicts a highly schematic perspective view of the semi-submersible vessel 1 according to FIG. 1. The drilling equipment 4 and moonpool 37 have been omitted in this drawing. From top to bottom are shown respectively, the operating deck 3, the icebreaking portion 17, the water portion 19, columns 33 and the pontoon 5.

The operating deck 3 has a circular shape, but any arbitrary shape can be used. As can be seen, just below the operating deck is the icebreaking portion provided, so that the icebreaking portion is partially integrated with lower decks below the operating deck.

Figure 3B:
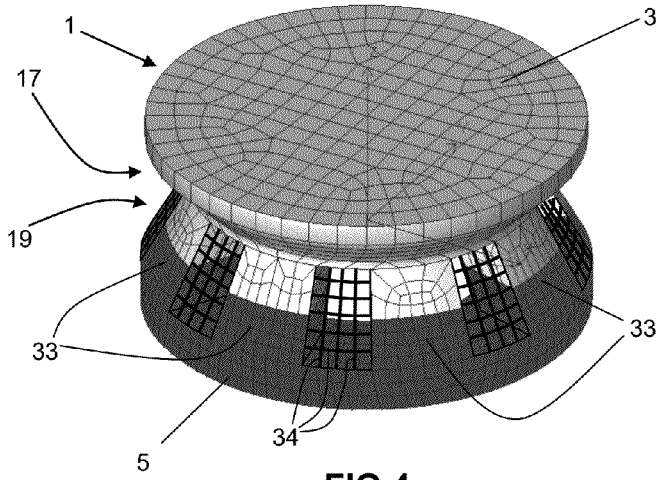
FIG. 3B depicts the semi-submersible vessel of FIG. 3A provided with an additional feature.

FIG. 3B depicts the semi-submersible vessel 1 of FIG. 3A, but now including a mesh structure in the openings between the columns 33. The mesh structure in this embodiment is formed by rigid rods 34 (of which only a few are indicated by reference numeral 34 for clarity reasons). The rigid rods define a grid with openings that are small enough to prevent ice parts that are large enough to pose a threat to the equipment inside the vessel from entering the vessel through the openings in between the columns. In an alternative embodiment, the mesh structure may be provided using a net with flexible cables or wires in the place of the rigid rods.

In an embodiment, ice parts or element entering the central space may be prevented by cooling of the mesh structure thereby forming ice in between the rigid rods 34 and closing off the openings in the mesh structure. When the openings in the mesh structure need to be opened again, the mesh structure may be heated to remove the ice. Heating of the mesh structure may also be advantageously used to heat ice elements passing the openings in the mesh structure.

Cooling of the mesh structure can advantageously done using cold air from the environment, e.g. by passing the cold air through the rigid rod which may for this purpose provided with a central bore. The same bore can be used to let a warm fluid, e.g. heated cooling water from an engine, flow through the rigid rods to heat the mesh structure.

Figure 4:
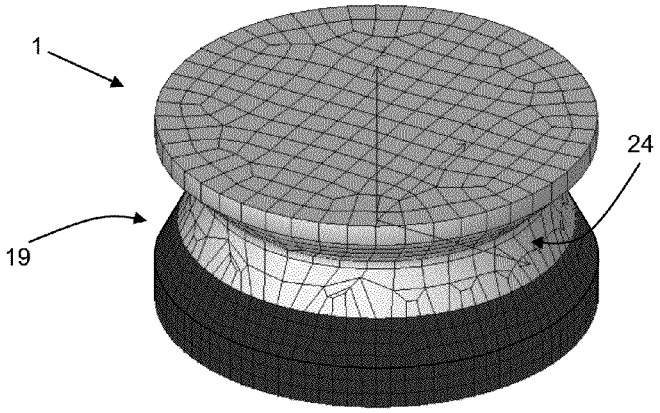
FIG. 4 depicts a highly schematic perspective view of a semi-submersible vessel according to another embodiment of the invention.

FIG. 4 depicts a highly schematic perspective view of a semi-submersible vessel 1 according to another embodiment of the invention. The vessel 1 is similar to the vessel 1 of FIG. 3A, but the water portion 19 has a closed contour 24 instead of columns.

Figure 5:
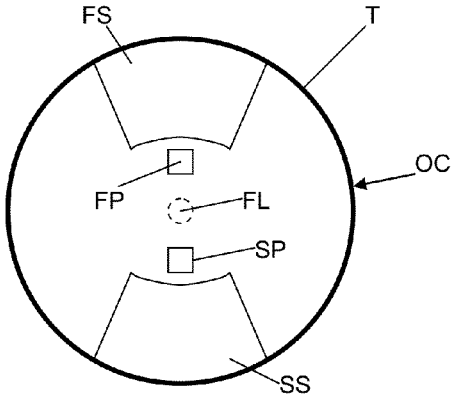
FIG. 5 depicts a horizontal cross-sectional view of a drilling installation according to an embodiment of the invention.

FIG. 5 depicts a horizontal cross-sectional view of a drilling installation according to an embodiment of the invention. The drilling installation comprises a tower T having a circular closed outer contour wall OC in plan view.

The drilling installation further comprises hoisting means adapted to manipulate drilling tubulars in at least one vertically extending firing line FL. The hoisting means may partially or fully be arranged inside the tower T. Hoisting winches are preferably arranged outside the tower, in a separate room, especially when the outer contour is closed.

Inside the tower T, a first storage device FS and a second storage device SS for storing drilling tubulars are provided. The storage devices may have slots or fingerboards in which the drilling tubulars can be suspended vertically. Between the first storage device FS and the firing line a first pipe racker FP is provided for moving drilling tubulars between the first storage device and the firing line. Similarly, a second pipe racker SP is provided between the second storage device and the firing line for moving drilling tubulars between the second storage device and the firing line.

Figure 6:
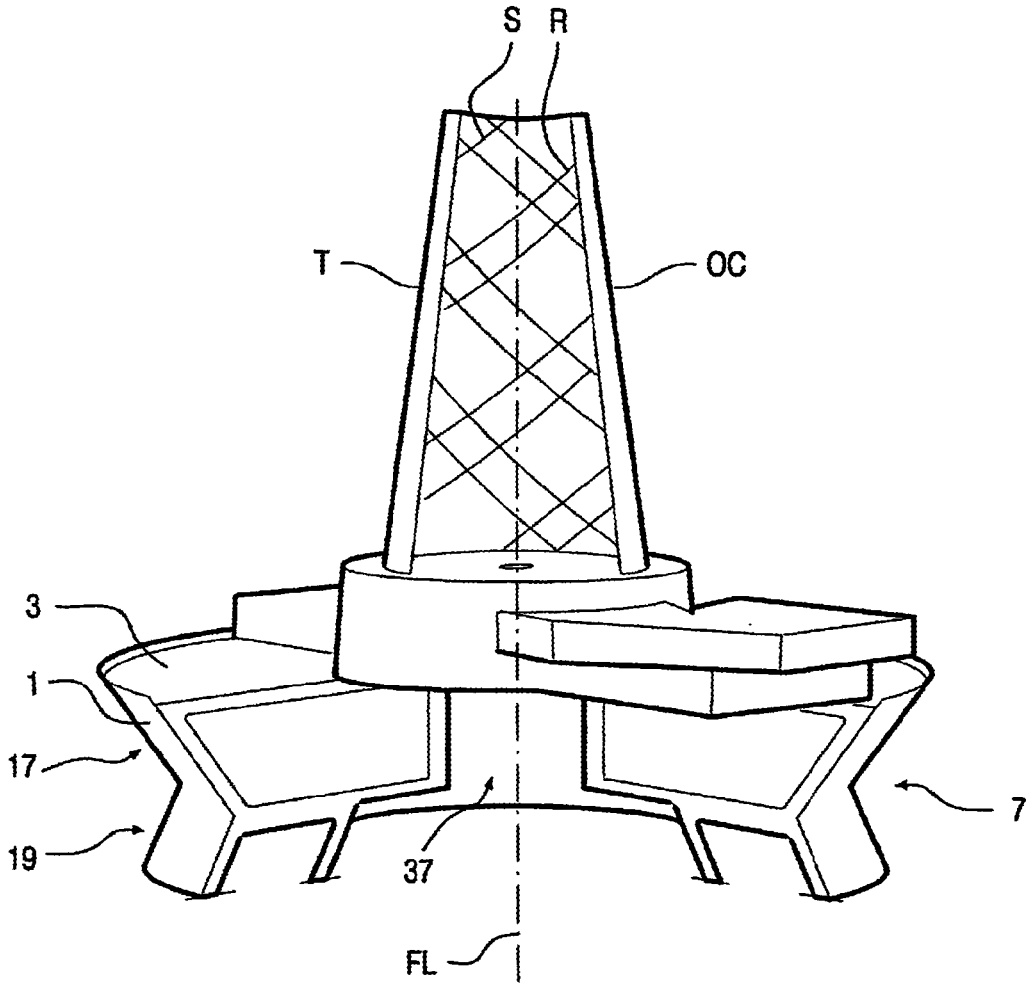
FIG. 6 depicts a perspective view of a partially cut-away semi-submersible vessel with a drilling installation according to another embodiment of the invention.

FIG. 6 depicts a partially cut-away semi-submersible vessel 1 according to the invention comprising a drilling installation according to the invention.

The vessel 1 comprises an operating deck 3, a pontoon hidden below the water, and a connecting structure 7 connecting the operating deck with the pontoon. The connecting structure comprises an icebreaking portion 17 having a tapered outer contour and a water portion 19. Together the icebreaking portion and the water portion define an hourglass shape.

Extending through the operating deck and the icebreaking portion is a moonpool 37 to allow drilling operations to be performed through the vessel. For the drilling of a well, the vessel comprises a drilling installation on top of the operating deck. For simplicity reasons only a tower T and a firing line FL are shown. The tower has a closed outer contour OC, which is partially cut away to show the inside of the tower T. The outer contour OC is in this embodiment formed by plate like material which is self-supporting, i.e. does not need a framework to keep its shape. However, during drilling, the loads on the tower may be relatively large, so that in this embodiment, the outer contour is reinforced by strengthening ribs SR running on the inside of the tower T. Alternatively, they could run on the outside of the tower. In this embodiment, the strengthening ribs SR are helical shaped and run from a bottom to a top of the tower.

Not shown in FIG. 6 is that the top of the tower T may be closed in an appropriate manner to prevent rain or snow to enter the tower from above.

The invention claimed is:

1. A semi-submersible vessel for offshore operations which is suitable to be operated in icy waters and in ice-free waters, said vessel comprising:

an operating deck to accommodate equipment;

at least one lower hull;

an essentially vertical connecting structure between the at least one lower hull and the operating deck; and a ballast system to ballast or deballast the vessel, wherein the connecting structure has a water portion and an icebreaking portion being arranged on top of each other, wherein the water portion of the connecting structure is formed by multiple columns, wherein the vessel is configured to have an icebreaking draft for icy waters in which the water- or iceline is substantially level with the icebreaking portion, and a water draft for ice-free waters in which the waterline is substantially level with the multiple columns of the water portion, wherein the icebreaking portion has a single closed tapered contour, and wherein during the water draft the collective area of the water portion of the connecting structure intersecting the water surface is smaller than the collective area of the icebreaking portion of the connecting structure intersecting the water surface during the icebreaking draft.

2. The semi-submersible vessel according to claim 1, wherein the icebreaking portion is located between the water portion and the operating deck.

3. The semi-submersible vessel according to claim 2, wherein the icebreaking portion is essentially circular.

4. The semi-submersible vessel according to claim 1, wherein the water portion is located between the icebreaking portion and the at least one lower hull.

5. The semi-submersible vessel according to claim 1, wherein the icebreaking portion is essentially circular.

6. The semi-submersible vessel according to claim 1, wherein the vessel comprises at least one lower deck below the operating deck which at least one lower deck is integrated in the icebreaking portion.

7. The semi-submersible vessel according to claim 1, comprising a subsea drilling installation and a moonpool through the one or more decks through which drilling operations can be performed.

8. The semi-submersible vessel according to claim 7, further comprising a protective wall extending downwards from the vessel in a central space around the moonpool as protection of the drilling equipment extending through the moonpool against ice that has entered the central space.

9. The semi-submersible vessel according to claim 8, wherein the protective wall extends to below the water draft.

10. The semi-submersible vessel according to claim 1, wherein the columns extend from the lower hull obliquely inwards towards a centre of the vessel.

11. The semi-submersible vessel according to claim 1, wherein the water portion has one or more openings provided with a net or mesh structure to prevent ice from entering a central space in the water portion via the one or more openings.

12. The semi-submersible vessel according to claim 11, wherein the net or mesh structure is configured to be used as heating and/or cooling element.

13. The semi-submersible vessel according to claim 1, wherein additional openings or through holes extend through the operating deck up until a central space below the operating deck, so that air is able to flow between the central space and the surroundings of the vessel via the openings or through holes.

14. The semi-submersible vessel according to claim 13, wherein the openings or through holes are provided with respective valves to allow the controlled opening or closing of the openings or through holes.

15. The semi-submersible vessel according to claim 1, wherein the area of the connecting structure being intersected by the water surface during the water draft in water draft conditions comprises multiple separate cross-sections corresponding to the respective multiple columns, wherein the multiple separate cross-sections are placed in a circular manner to define a circumscribed circle and in inscribed circle together forming a ring shape, wherein the collective area of the multiple separate cross-sections being intersected by the water surface in water draft is between 50% and 70% of the total area of the ring shape.

16. The semi-submersible vessel according to claim 15, wherein the collective area of the multiple separate cross-sections being intersected by the water surface in water draft is 60% of the total area of the ring shape.

17. The semi-submersible vessel according to claim 15, wherein the water portion comprises eight columns.

18. The semi-submersible vessel according to claim 1, wherein the lower hull is ring-shaped with an opening, and wherein the opening in the lower hull and/or openings in between the multiple columns are adjustable during operation.

19. The semi-submersible vessel according to claim 1, wherein the connecting structure further includes an intermediate portion arranged between the water portion and the icebreaking portion, the intermediate portion having a closed vertically extending contour.

20. A method for operating the semi-submersible vessel according to claim 1, wherein the ballast system is operated to change the draft of the semi-submersible vessel to the water draft when the semi-submersible vessel is in ice-free waters, and wherein the ballast system is operated to change the draft of the semi-submersible vessel to the icebreaking draft when the semi-submersible vessel is in icy waters.

* * * * *